US005594456A

United States Patent [19]

Norris et al.

[11] Patent Number: 5,594,456

[45] Date of Patent: Jan. 14, 1997

[54] GAS TUBE RF ANTENNA

[75] Inventors: Elwood G. Norris, Poway, Calif.; David W. O'Bryant, Sandy, Utah

[73] Assignee: Patriot Scientific Corporation, Poway, Calif.

[21] Appl. No.: 302,129

[22] Filed: Sep. 7, 1994

[51] Int. Cl.[6] ..... H01Q 1/26; H01Q 13/10

[52] U.S. Cl. ..... 343/701; 343/767; 343/785

[58] Field of Search ..... 343/701, 785, 343/767

[56] References Cited

U.S. PATENT DOCUMENTS

| | | | |
|---|---|---|---|
| 3,404,403 | 10/1968 | Vallese et al. | 343/700 |
| 3,634,767 | 1/1972 | Roeder | 325/363 |
| 3,719,829 | 3/1973 | Vaill | 307/149 |
| 4,001,834 | 1/1977 | Smith | 343/795 X |
| 4,028,707 | 6/1977 | Young et al. | 343/5 NA |
| 4,062,010 | 12/1977 | Young et al. | 343/5 NA |
| 4,090,198 | 5/1978 | Canty et al. | 343/18 D |
| 4,347,512 | 8/1982 | Sweeney | 343/6.5 R |
| 4,574,288 | 3/1986 | Sillard et al. | 343/781 P |
| 4,989,013 | 1/1991 | Smith, II et al. | 343/721 |
| 5,175,560 | 12/1992 | Lucas et al. | 343/767 |

*Primary Examiner*—Peter A. Nelson
*Attorney, Agent, or Firm*—Thorpe, North & Western

[57] ABSTRACT

An antenna device for transmitting a short pulse duration signal of predetermined radio frequency that eliminates a trailing antenna resonance signal. The device includes a gas filled tube; a voltage source for developing an electrically conductive path along a length of the tube corresponding to a resonant wavelength multiple of the predetermined radio frequency; and a signal transmission source coupled to the tube for supplying a radio frequency signal to the conductive path for antenna transmission. A method for transmitting a short pulse signal without a trailing residual signal is also provided.

48 Claims, 3 Drawing Sheets

GAS TUBE RF ANTENNA

BACKGROUND OF THE INVENTION

1. Field of the Invention

This invention pertains to radio frequency (RF) antennae, and in particular to RF antennae adapted for short bursts of signal transmission, where a short burst is characterized by a discrete signal with no residual antenna resonance.

2. Prior Art

Since the inception of electromagnetic theory and the discovery of radio frequency transmission, antenna design has been an integral part of virtually every telemetry application. Countless books have been written exploring various antenna design factors such as geometry of the active or conductive element, physical dimensions, material selection, electrical coupling configurations, multi-array design, and electromagnetic waveform characteristics such as transmission wavelength, transmission efficiency, transmission waveform reflection, etc. Technology has advanced to provide unique antenna design for applications ranging from general broadcast of RF signals for public use to weapon systems of highly complex nature.

Two particular areas of prior art have specific relevance to the present invention. First, U.S. Pat. Nos. 4,028,707 and 4,062,010 illustrate various antenna structures consisting of wire and metal conductors which are appropriately sized for antenna operation with ground penetrating radar. Second, U.S. Pat. Nos. 3,404,403 and 3,719,829 describe the use of a plasma column formed in air by laser radiation as the antenna transmission element.

In its most common form, the antenna represents a conducting wire which is sized to emit radiation at one or more selected frequencies. To maximize effective radiation of such energy, the antenna is adjusted in length to correspond to a resonating multiplier of the wavelength of frequency to be transmitted. Accordingly, typical antenna configurations will be represented by quarter, half and full wavelengths of the desired frequency. Effective radiation means that the signal is transmitted efficiently. Efficient transfer of RF energy is achieved when the maximum amount of signal strength sent to the antenna is expended into the propagated wave, and not wasted in antenna reflection. This efficient transfer occurs when the antenna is an appreciable fraction of transmitted frequency wavelength. The antenna will then resonate with RF radiation at some multiple of the length of the antenna.

Although this essential resonating property is fundamental to the construction of an effective antenna, it also creates a dichotomy where a short burst of RF radiation is desired. For example, in many instances, a short pulse of emitted RF radiation is desired in a discrete packet having sharply defined beginning and ending points. One such application is in radar transmissions where reflections of the radiation are of primary interest. These reflections (backscatter) occur as the electromagnetic radiation passes through materials of differing dielectric constant. It is often desirable that these reflections provide detectable properties that whose interpretation can identify the object of interest (airplane, missile, etc.). The predictability of the reflected signal is in part dependent upon the uniform nature of emitted signals at the antenna and interference by secondary reflections with the returning signal.

The dominant use of radar has been within the aerospace industry. One reason that radar has generally been focused in this application is because an atmosphere environment is of uniform continuity and provides an ideal transmission medium. Therefore, an airborne object is easily distinguished because it is generally an isolated structure that provides an uncluttered reflection. It is therefore easy to identify an airborne object by its electromagnetic reflection.

However, an area of increasing interest and importance is ground penetrating radar. The ability to map what is beneath the surface of the earth or under debris has become necessary for a variety of reasons. For example, locating the precise position of underground pipes and cables can be accomplished without wasting time digging, and with minimal disturbance of soil. However, in this instance, the variety of materials (rocks, sand, soil, vegetation and debris) in the transmission medium with varying dielectric constants creates an array of RF reflections that resemble background noise and clutter. In an effort to minimize the amount of background reflection, the common practice has been to emit a small burst of RF energy, and then evaluate the reflected signal based on this short burst. In this manner, the reflections are limited to short pulses, rather than a repeating wave front. Backscatter is therefore clearer if (i) there is no interference with new signals from the transmission source, and (ii) multiple reflections between target objects are held to a minimum. Thus, it is desirable to terminate all transmission signals before a new signal is sent.

U.S. Pat. Nos. 4,028,707 and 4,062,010 by Young et. al. illustrate two similar approaches for generating and detecting wave pulses within a ground radar application. As will be noted, substantial emphasis is placed on techniques for forming the wave pulse, including design considerations for the transmitting antenna. Numerous configurations for improving the shape of the emitted pulse have been conceived during the twenty-five years since issuance of the respective patents by Young et al.

Despite the need and ongoing interest in improving antennae capable of generating a discrete pulse transmission, a recurring problem is the resonating nature of the antenna. FIG. 1 illustrates a one cycle signal 10 such as might be broadcast from a conventional antenna. At time $T_1$ the RF transmission coupled to the antenna is cut off; however, a residual signal 11 continues to oscillate over the trailing period despite termination of RF transmission energy to the antenna. When applied within a ground radar system, this trailing resonance signal 11 causes numerous reflections that create a complex array of unmanageable backscatter signals that generally resemble clutter. Obviously, it would be much preferred to have the one cycle pulse cut off instantly, leaving only reflections of the original signal 10, with no residual antenna resonance oscillations to create confusing reflections.

OBJECTS AND SUMMARY OF THE INVENTION

It is an object of the present invention to provide an antenna capable of generating a single pulse signal without transmission of a trailing resonance signal.

It is a further object of this invention to provide an antenna which can be instantly eliminated as a transmitting element.

A further object of this invention is to provide an antenna for use with penetrating microwave radar that avoids unnecessary reflected signals from trailing antenna resonance signals.

Another object of the present invention is the development of an antenna useful for transmitting short pulse signals for data transmission through barriers that tend to reflect radio frequency transmissions.

Yet another object of the invention is to provide an antenna useful for transmitting discrete signal packets that can be recognized as digital data by digital communication devices.

These and other objects are realized in an antenna device for transmitting a short pulse duration signal of predetermined radio frequency which includes a gas filled ionization tube as the transmitting element. Means are provided for developing an electrically conductive path along a length of the ionization tube corresponding to a resonant wavelength multiple of the predetermined radio frequency. A signal transmission source is also coupled to the tube for supplying a radio frequency signal to the electronically conductive path for antenna transmission.

Also disclosed is a method for generating a momentary antenna for transmission of short pulse, radio frequency signals with no trailing resonance transmissions. This method includes the steps of: a) selecting a gas tube with a length corresponding to a resonating multiple of a wavelength for the radio frequency signals to be transmitted; b) momentarily ionizing or otherwise energizing the gas tube to an electrically conductive state; c) transmitting the short pulse, radio frequency signals to the ionized gas tube; and d) immediately terminating the electrically conductive state of the gas tube following transmission of the short pulse radio frequency signals.

These and other objects and features of the present invention will be apparent to those skilled in the art based on the following detailed description taken in combination with the accompanying drawings.

DETAILED DESCRIPTION OF THE INVENTION

Figure 2:
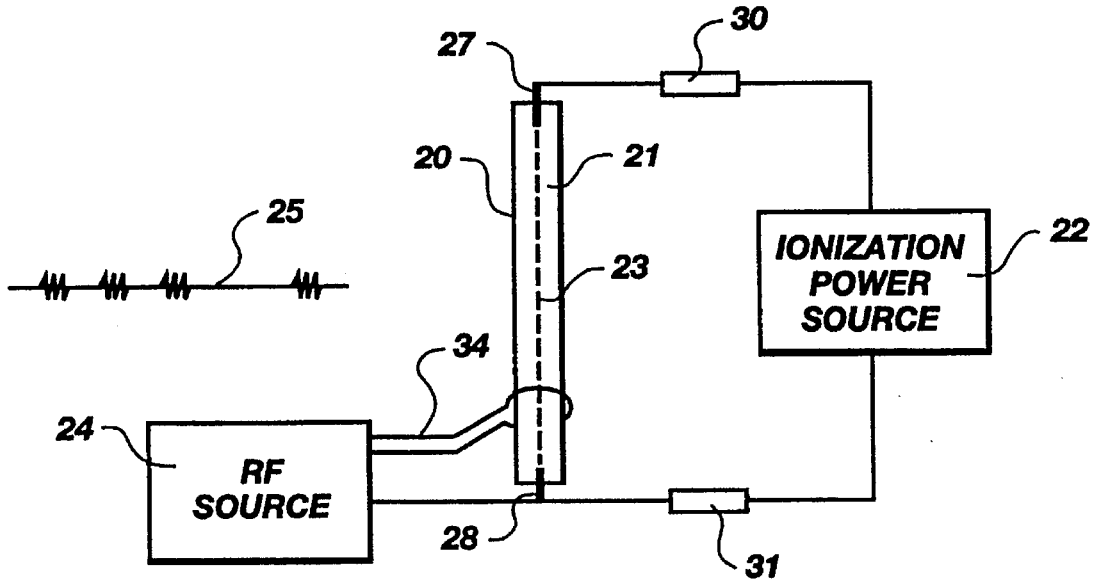
FIG. 2 illustrates in block diagram an embodiment of the present invention as a penetrating microwave radar.

An antenna device 20 for transmitting a short pulse duration signal of predetermined radio frequency is shown as part of an RF transmitting system in FIG. 2. The system includes a gas filled ionization tube 21, and an ionization power source 22 or other means for developing an electrically conductive path 23 along a length of the ionization tube 21 corresponding to a resonant wavelength multiple of the predetermined radio frequency. As used in this application, ionization tube is used in a broader sense than merely development of an ionized state of the contained gas. Instead, the meaning includes all gas tubes which are able to provide a conducting path capable of operating as a transmitting antenna. For example, conventional gas tubes containing neon, xenon, argon and krypton, as well as mixtures thereof, may be applied as part of this system.

Figure 1:
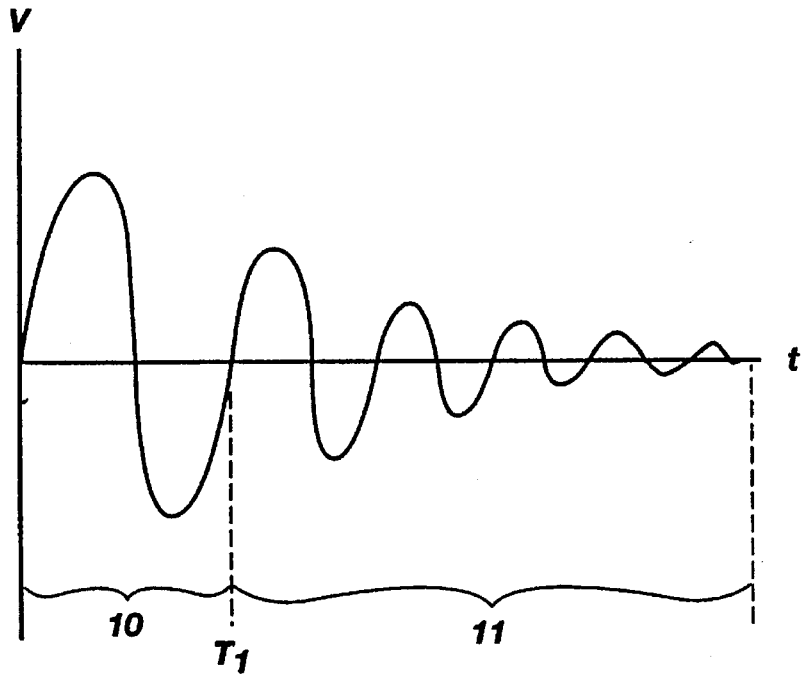
Fig. 1 (PRIOR ART)
FIG. 1 shows a graphic illustration of a signal transmitted from a conventional antenna, including a residual signal resonating after termination of an RF signal source at a specified time $T_1$.
Figure 3:
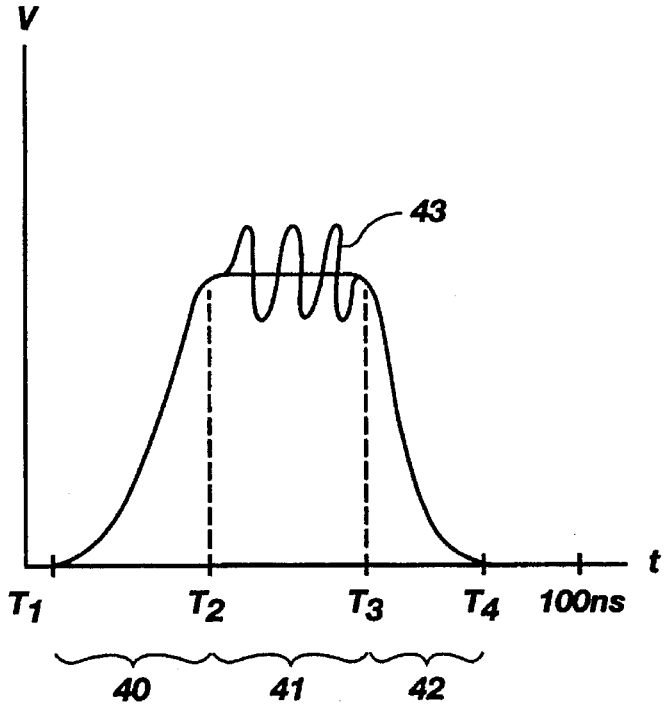
FIG. 3 depicts a short pulse signal transmitted in accordance with the present invention.
Figure 4:
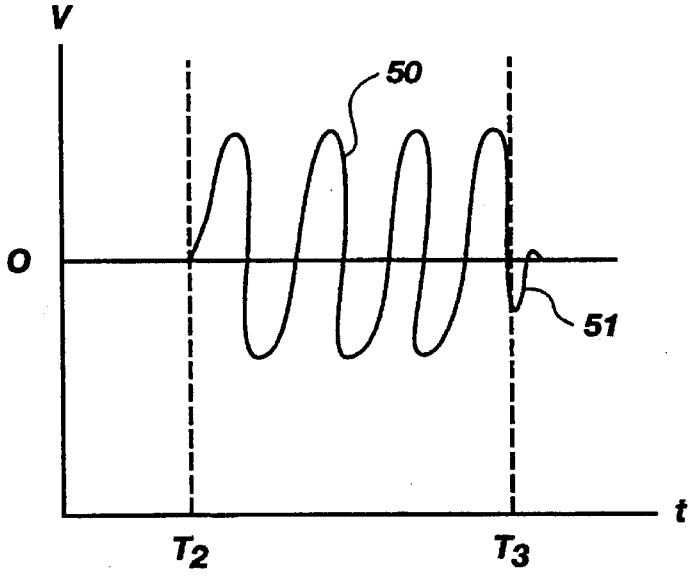
FIG. 4 shows a graphic representation of the transmitted signal of FIG. 3.

The ionization tube 21 includes opposing electrodes 27 and 28 positioned at opposite ends of the electrically conductive path 23 and provide the voltage differential to activate an ionized conductive path. The utilization of such a gas tube permits rapid initiation and termination of the conductive path because of the nature of the transmitting antenna element. The rapid switching effect between a transmitting and a nontransmitting state is accomplished not by removal of the RF source 24 from the conductive path 23, but rather by termination of the conductive path 23 itself. During gas ionization the gas tube 21 becomes an effective antenna element. When the conductive path 23 is terminated by cutting off the ionization power source 22, the antenna ceases to exist, and is therefore unable to produce an undesired trailing resonance signal 11 as is shown in FIG. 1. As a consequence, a clean pulse is achieved as is shown in FIGS. 3 and 4.

An RF signal transmission source 24 is coupled to the ionization tube 21 for supplying a radio frequency signal 25 to the conductive path 23 for antenna transmission. Such a signal source may include any conventional signal generating means that produces radar frequencies, AM or FM signals, as well as digital spread spectrum signals 25 which transmit short bursts of RF radiation separated by discrete time spans that provide the data carrier. Such signal transmission sources for initiating digitized data transmissions in short, noncontinuous bursts are well known in the industry.

The power source 22 coupled to the opposing electrodes can be any voltage source capable of establishing the threshold voltage required to maintain a conductive state within the gas tube 21 for the desired transmission duration. Radio frequency decoupling means such as inductors or chokes 30, 31 are positioned electrically between the ionization tube 21 and the power source 22 to prevent undesired radio frequency signals of the power source 22 from being coupled into and corrupting the electrically conductive path 23 with spurious signals. Those skilled in the art will be aware of numerous other decoupling devices and circuits which could be implemented for this purpose.

Generally, a spike voltage or other form of trigger means 34 is coupled to the ionization tube for initiating the electrically conductive path 23. This is required where the initial threshold voltage to develop electron flow is higher than the voltage required to maintain such a path. This trigger voltage can be supplied by a capacitor or other form of pulse generator. Where the conductive path 23 within the ionization tube 21 is sufficiently short and the respective initiating and maintenance voltages for conductivity are approximately the same, voltage levels supplied by the radio frequency to be transmitted may be sufficient to create the ionized state of gas and transmit, without the need for separate triggering or ionized state maintenance means.

The triggering means 34 or RF source 24 may also include a timing circuit for correlating and synchronizing (i) initiation of the conductive path 23 immediately prior to arrival of the radio frequency signal 25 to be transmitted, and (ii) cut-off for terminating conductivity of the ionization tube 21 immediately subsequent to transmission of the radio frequency signal 25. Thus, the antenna is able to instantly terminate antenna transmission and minimize trailing resonance transmission. Such circuits are well known in the industry and need no further explanation.

A significant advantage of the gas tube configuration of antenna in accordance with the present invention is its ability to be adapted to different lengths and geometric configurations. Unlike the laser monopole antenna of the prior art that by its nature is created in a straight line configuration, fluorescent tubes of gas are created in many shapes and are limited only by the dynamics of the material used for construction. In essence, this enables implementation of the substantial technology which has developed with respect to wave shaping based on specific antenna geometries. In addition, tube lengths can be tailored to any desired harmonic multiplier of the wavelength to be broadcast. This includes a conventional one-quarter wavelength design that is noted for efficient transfer of RF energy to the propagated electromagnetic waveform.

There are several other advantages of the gas tube configuration over the prior art laser monopole antenna. Specifically, the ionized trail 23 in the tube 21 requires less energy to maintain its ionized state because the tube confines the gas, preventing dissipation. Using less energy enables the applied radio frequency transmission 25, in some cases, to supply the energy to the gas necessary to maintain the ionized state. This reduces reliance on an external source of power to ionize the gas and prepare for transmission of the signal. The ability to use different gases also gives an advantage over using air as the ionized antenna medium. The present invention is not limited to the rise and fall time characteristics of air, but can instead take advantage of other gases, or a mixture of gases.

The selection of specific gases and tube environments can also be tailored to control physical operating parameters of the gas tube antenna. For example, each gas has a characteristic rise and fall time associated with its conductive state. In FIG. 3, voltage of the gas tube is represented versus time, illustrating rise and fall times 40, 42. The level section 41 of the waveform conforms to the period of conductivity of the gas tube. The rise time extends from $T_1$ to $T_2$ and the fall time covers the time span from $T_3$ to $T_4$. In most instances of short pulse transmissions, minimizing the rise and fall time is desired to enable short and rapid bursts of transmission signal 43. Obviously, the shorter the fall time 42, the shorter the trailing resonance signal will be. Similarly, the shorter the rise time 40, the more rapid is the potential repetition rate of transmission of short energy bursts. Rise and fall times should be less than 100 nanoseconds to enable the antenna to be used in short pulse transmissions.

The superimposed transmission signal 43 of FIG. 3 is isolated in FIG. 4. The advantage of the gas tube antenna is clear, in view of the uniform wave configuration 50 with nominal trailing edge 51. When applied to a penetrating microwave radar system, the occurrence of a single pulse package of uniform frequency and amplitude greatly reduces the types and number of reflected signals which must be analyzed for detection of target objects. Similarly, the transmission of digital pulses as part of a data train is enabled because of the absence of post transmission radiation following each energy burst as is shown in FIG. 2, item 25.

These features are also comprehended by a method for development of a "momentary antenna" for transmission of short pulse, radio frequency signals with no trailing resonant transmissions. The method involves the steps of:

a) selecting a gas tube with a length corresponding to a resonating multiple of a wavelength for the radio frequency signals to be transmitted;

b) momentarily ionizing or otherwise energizing the gas tube to an electrically conductive state;

c) transmitting the short pulse, radio frequency signals to the ionized gas tube; and d) immediately terminating the conductive state of the gas tube following transmission of the short pulse radio frequency signals.

The momentary antenna, however, will not be restricted to broadcasting at only one frequency. Although certain transmission wavelengths will inherently have better power transfer efficiency, the same antenna could generate signals at radio frequencies of other resonating multiples of a wavelength of the frequency being transmitted. This ability will enable multiplexing and transmission of various radio frequencies using the same length gas tube. Other procedures to be included as part of this methodology will be apparent to those skilled in the art, based upon the preceding description.

Figure 5:
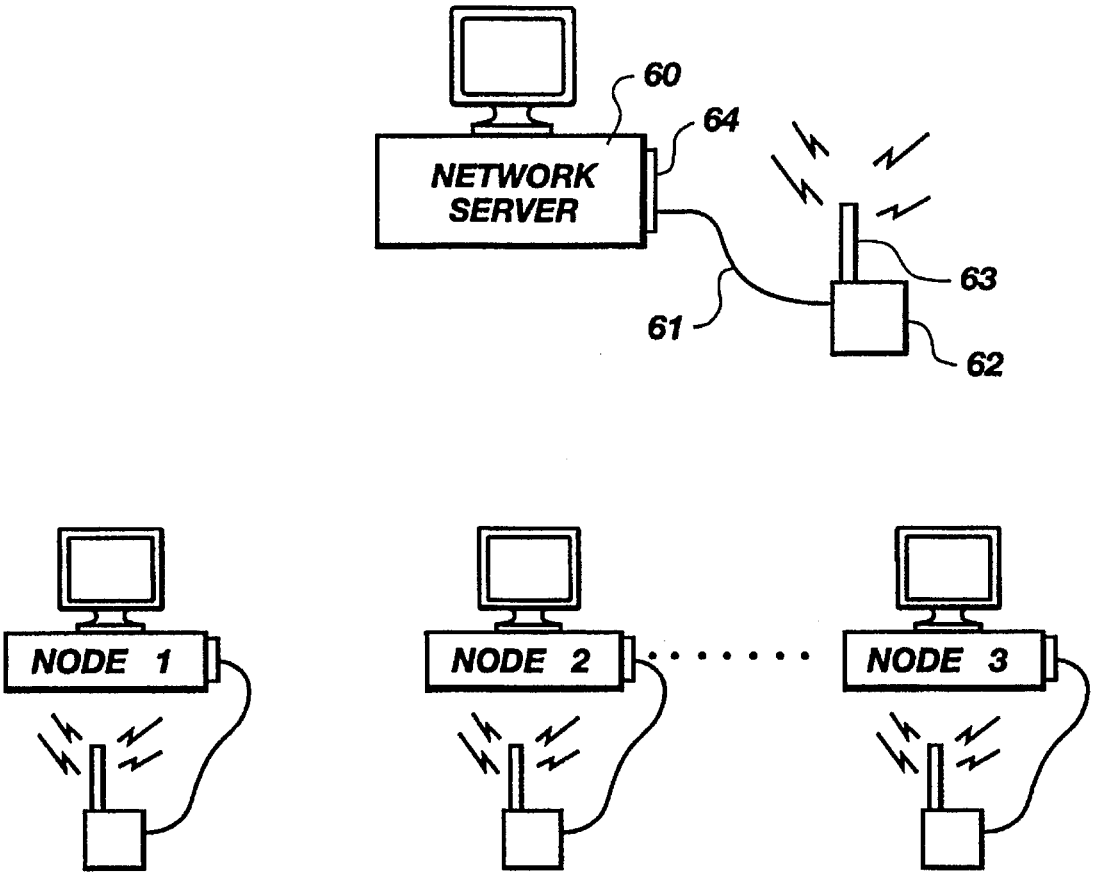
FIG. 5 shows a block diagram of an embodiment of the present invention incorporated into a computer local area network (LAN).

FIG. 5 illustrates an example of short pulse transmission application in the field of wireless digital communications. More specifically, the present invention is ideally suited for computer local area networks (LANs). Computer networks use packets of digital data to communicate, typically over a cable or wire medium. Digital data is not transmitted in its raw binary, octal or hexadecimal format, but is instead encoded for such purposes as more efficient speed, error correction, and security when transmitted over a LAN. There are many ways to encode and subsequently decode digital data. The resulting rules and methods are defined as transmission protocols. A transmission protocol determines what digital data will be transmitted in a single packet. A packet contains sufficient data to define the type of transmission protocol used to encode the data carried by the packet so that receiving devices can extract the useful digital data. A transmission protocol for computer networks in wide use today is ethernet. Ethernet currently operates at a transmission rate of 10 megabits per second. This results in a data bit having a maximum of 100 nanoseconds in which to rise, transmit, and fall. The present invention can use a gas or mixture of gases that allow the antenna to transmit data well within the tolerance limits of the ethernet specification.

As shown in FIG. 5, a network using the present invention consists of a network server or servers, and additional nodes on the network. Nodes may be any processing device typically found on LANs such as computer workstations, terminals, printers, scanners, concentrators, bridges, repeaters, or other input/output devices. Each node is equipped with a standard network interface card (NIC) used in the industry to encode and decode packets of digital data according to industry protocols.

Typically, a processor of a node will send digital data to a NIC. The NIC will encode data according to predefined software settings and the hardware capabilities of the NIC. The encoded data will then be communicated over a transmission medium to other network nodes.

In this representative embodiment, server 60 has N nodes on a local area network (LAN). The NIC 64 would transmit a data packet compliant with industry standard protocols over a short length of wire 61 to the gas tube antenna transmit/receive device 62 equipped with a gas tube antenna 63. Each transmit/receive device 62 is capable of receiving a digital data packet from the transmitting node over a wire 61 and transmitting said data packet as an RF signal. Each transmit/receive device 62 is also capable of receiving RF signals, and transmitting the received digital data packet over a wire 61 to the receiving node's NIC 64. The transmit/receive device 62 also has the means to translate between a protocol that the NIC 64 is capable of encoding and decoding, and the radio frequency signals received and transmitted by the antenna. The present invention also takes advantage of computer LAN components already installed by not replacing the NIC of existing nodes. In this way, the gas antenna 63 and the transmit/receive device 62 only replace the cabling medium, thus simplifying installation of the invention in existing networks.

The advantages of such an application of the gas tube antenna are many. For example, upgrading the existing cabling presently used by a LAN would require installation of new cabling, a time consuming process that will have to be repeated when LAN transmission rates increase again. The present invention will only require replacement of easy to access circuitry or a gas tube placed next to the node. Another problem is exceeding cable lengths when trying to reach nodes that are distant from the server. The present invention can transmit distances that prior art cabling is incapable of doing. In addition, access to the cabling can be difficult when cable is hidden in walls and ceilings. The problem is compounded when the cabling extends between numerous floors of a building. Utilizing the present invention will eliminate the need for gaining access to difficult to reach locations, decreasing overall installation time of LANs. Repair is also easier when the LAN transmission components are sitting next to each node on the network, instead of buried behind building walls.

The invention may also significantly reduce or eliminate the hardware requirements of prior art LANs. At present, network concentrators or HUBs are used in many network topologies. These devices serve as local branching locations from which all nodes within cabling distance attach to the network. When the number of nodes exceeds the number of attachment ports on a concentrator, an expansion concentrator must be coupled to the existing one, even if only one additional node is being added. The present invention eliminates the need for concentrators when the distance between all nodes is within the maximum transmission range of the gas antenna. However, even if the maximum range is exceeded, the network will only require the addition of repeaters to boost the signal strength so that all nodes receive the signal.

Figure 6:
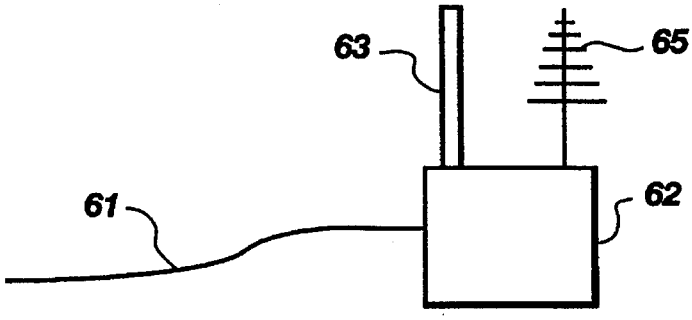
FIG. 6 shows an alternate configuration of antenna for use in the computer local area network of FIG. 5.

FIG. 5 is not the only configuration that a computer LAN must have when using the present invention. As FIG. 6 shows, the gas tube antenna 63 is only necessary for transmission of the digital data packet. Any appropriately sized antenna may act as the reception antenna 65 for the node. Using a separate antenna for reception would also result in reduced power consumption because the gas in the tube would not have to be maintained in an ionized state for reception of RF signals. In addition, nodes that use the gas antenna for reception in combination with nodes that have a separate receiving antenna enable construction of a LAN tailored to the needs of the user.

Other applications of this antenna system will be apparent to those skilled in the art, and are intended to be part of the general disclosure provided herein. The examples provided are merely exemplary of the principles, methodology and apparatus representing the subject invention. Accordingly, the specific embodiments and procedures are not to be considered as limiting with respect to the actual invention as defined by the following claims.

What is claimed is:

1. An antenna device for transmitting a short pulse duration signal of predetermined radio frequency, said device comprising:

a gas filled tube;

means for generating an electrically conductive path along a length of the gas filled tube corresponding to a resonant multiple of a wavelength of the predetermined radio frequency;

means for decoupling from the electrically conductive path along a length of the gas filled tube any undesired radio frequency signals that might be produced by a power source generating the electrically conductive path; and a radio frequency signal transmission means coupled to the gas filled tube for supplying the short pulse radio frequency signal to the electrically conductive path for transmission by the antenna.

2. A device as defined in claim 1, wherein the electrically conductive path along a length of the gas filled tube has a length of at least approximately one-fourth the wavelength of the predetermined radio frequency.

3. A device as defined in claim 1, wherein the gas filled tube includes a gas having rise and fall times associated with the generation of the electrically conductive path that total less than 100 nanoseconds.

4. A device as defined in claim 1, further comprising a trigger means coupled to the gas filled tube for initiating the electrically conductive path.

5. A device as defined in claim 1, wherein said means for developing the electrically conductive path comprises a power source coupled to the gas filled tube for establishing a required voltage level to enable selective initiation of the electrically conductive path, said power source including radio frequency decoupling circuitry.

6. A device as defined in claim 5, wherein the gas filled tube includes opposing electrodes positioned at opposite ends of the electrically conductive path, said power source being coupled to the opposing electrodes and further including radio frequency decoupling means positioned electrically between the gas filled tube and the power source to prevent undesired radio frequency signals of the power source from being coupled into the electrically conductive path.

7. A device as defined in claim 1, wherein the electrically conductive path along a length of the gas filled tube is sufficiently short to enable triggering of the electrically conductive path based on voltage levels supplied by the short pulse radio frequency signal to be transmitted, without need for separate triggering means.

8. A device as defined in claim 4, wherein the trigger means includes a timing circuit associated with the radio frequency signal transmission means for coordinating synchronized initiation of the electrically conductive path immediately prior to arrival of the radio frequency signal to be transmitted, and further comprising cut-off means coupled to the means for generating the electrically conductive path for terminating said conductivity of the path in the gas filled tube immediately subsequent to transmission of the radio frequency signal to instantly terminate antenna transmission and thereby minimize a trailing resonant antenna transmission.

9. A device as defined in claim 1, wherein the gas filled tube includes a gas selected from the group consisting of neon, xenon, argon, krypton and combinations thereof.

10. A device as defined in claim 1, wherein the radio frequency signal transmission means comprises circuitry for initiating data transmissions of short, discrete, radio frequency bursts that can be received as digital data.

11. A device as defined in claim 10, further including a timing circuit associated with the radio frequency signal transmission means, including means for coordinating synchronized initiation of the electrically conductive path immediately prior to arrival of each digital data transmission, and including cut-off means for terminating the electrically conductive path in the gas filled tube immediately upon complete transmission of each digital data transmission, to instantly terminate antenna transmission.

12. An antenna device for enabling transmission of short bursts of radio frequency signals without occurrence of trailing resonance signals, said device comprising:

a gas filled tube having opposing electrodes for activating an electrically conducting state of gas contained within the gas filled tube, said state of gas creating an electrically conductive path having a length approximately equal to a resonant multiple of a wavelength of the radio frequency signal to be transmitted;

trigger means coupled to the gas filled tube for initiating the electrically conducting state of gas;

a power source coupled to the opposing electrodes for supplying sufficient voltage to maintain the electrically conducting state of gas for a controlled period of time;

a means of decoupling undesired radio frequency transmissions from the electrically conducting state of gas, produced by the power source that generates the electrically conductive path; and a source of radio frequency signals coupled to the tube for enabling transmission through the electrically conducting state of gas as a short duration antenna.

13. A device as defined in claim 12, wherein the gas filled tube length is at least approximately one-fourth the wavelength of the predetermined radio frequency.

14. A device as defined in claim 12, wherein the gas filled tube includes a gas having rise and fall times associated with the generation of the electrically conductive path that total less than 100 nanoseconds.

15. A device as defined in claim 12, further comprising a trigger means coupled to the gas filled tube for initiating the electrically conductive path along a length of the gas filled tube.

16. A device as defined in claim 12, wherein the gas filled tube includes opposing electrodes positioned at opposite ends of the electrically conductive path, said power source being coupled to the opposing electrodes and further including radio frequency decoupling means positioned electrically between the gas filled tube and the power source to prevent undesired radio frequency signal from the power source from being coupled into the electrically conductive path.

17. A device as defined in claim 12, wherein the electrically conductive path along a length of the gas filled tube is sufficiently short to enable triggering of the electrically conductive state of the gas based on voltage levels supplied by the radio frequency to be transmitted, without need for separate triggering means.

18. A device as defined in claim 15, wherein the trigger means includes a timing circuit associated with the radio frequency signal transmission means for coordinating synchronized initiation of the electrically conductive path immediately prior to arrival of the radio frequency signal to be transmitted, and further comprising cut-off means coupled to the means for generating the electrically conductive state of the gas for terminating said conductivity of the gas filled tube immediately subsequent to transmission of the radio frequency signal to instantly terminate antenna transmission and thereby minimize a trailing resonance antenna transmission.

19. A device as defined in claim 12, wherein the gas filled tube includes a gas selected from the group consisting of neon, xenon, argon, krypton and combinations thereof.

20. A device as defined in claim 12, wherein the radio frequency signals transmission means comprises circuitry for initiating data transmissions in short, noncontinuous, radio frequency bursts that can be received as digital data.

21. A device as defined in claim 20, further including a timing circuit associated with the radio frequency signal transmission means, including means for coordinating synchronized initiation of the electrically conductive state of gas immediately prior to arrival of each digital data transmission, and including cut-off means for terminating the electrically conductive state of gas immediately upon complete transmission of each digital data transmission, to instantly terminate antenna transmission.

22. A method for generating a momentary antenna for transmission of short pulse, radio frequency signals with no trailing resonant transmissions, comprising the steps of:

a) selecting a gas filled tube with a length corresponding to a resonant multiple of a wavelength of the radio frequency signals to be transmitted;

b) momentarily transforming the gas in the gas filled tube to an electrically conductive state;

c) transmitting the short pulse, radio frequency signals to the gas filled tube; and d) immediately terminating the electrically conductive state of the gas in the gas filled tube following transmission of the short pulse, radio frequency signals.

23. A method as defined in claim 22, comprising the more specific step of selecting a gas filled tube having a sufficiently short length to enable the electrically conductive state of gas with a low voltage signal supplied as part of the short pulse, radio frequency signals.

24. A method for transmission of discrete, radio frequency signals suitable for use as digital data, said method comprising the steps of:

a) selecting a gas filled tube with a length corresponding to a resonant multiple of a wavelength of the radio frequency signals to be transmitted;

b) selecting a gas sealed within the gas filled tube that has a sufficiently short rise and fall time to enable transmission of discrete, radio frequency signals;

c) momentarily transforming said gas sealed in the gas filled tube to an electrically conductive state;

d) transmitting the discrete, radio frequency signals to the gas filled tube; and e) immediately terminating the electrically conductive state of the gas in said gas filled tube following transmission of the discrete, radio frequency signals.

25. A method for reception of discrete, radio frequency signals suitable for use as digital data, said method comprising the step of selecting an antenna with a length corresponding to a resonant multiple of a wavelength of the radio frequency signals to be received.

26. A method as defined in claim 25, wherein selecting an antenna comprises the more specific steps of:

a) selecting a gas filled tube with a length corresponding to a resonant multiple of a wavelength of the radio frequency signals to be received;

b) selecting a gas for the gas filled tube that has a sufficiently short rise and fall time to enable reception of discrete, radio frequency signals;

c) transforming said gas sealed in the gas filled tube to an electrically conductive state.

27. An antenna means for transmitting a discrete signal of predetermined radio frequency suitable for use as digital data, said antenna means comprising:

a gas filled tube;

means for generating an electrically conductive path along a length of the gas filled tube corresponding to a resonant multiple of a wavelength of the predetermined radio frequency;

means for decoupling from the electrically conductive path any undesired radio frequency signals produced by a power source generating the electrically conductive path;

a signal transmission means coupled to the gas filled tube for supplying a radio frequency signal to the electrically conductive path for transmission by the antenna;

means for coupling said signal transmission means to a trigger, said trigger terminating the electrically conductive path to enable transmission of discrete radio frequency signals with no trailing resonant transmissions.

28. The antenna means of claim 27, wherein the signal transmission means is associated with a processor means, said processor means including means for sending data for transmission to the signal transmission means.

29. The antenna means of claim 27, further comprising a signal reception means coupled to the antenna means.

30. The antenna means as defined in claim 29, wherein the signal reception means is associated with a processor means, said processor means including means for receiving data from the signal reception means and sending data for transmission to the signal transmission means.

31. The antenna means as defined in claim 28, wherein the processor means includes means for receiving data from a signal reception means coupled to a second antenna means.

32. The communication system as defined in claim 31, wherein the second antenna means further comprises an antenna having a length corresponding to a resonant multiple of a wavelength of a radio frequency to be received.

33. The communication system as defined in claim 32, wherein the second antenna means further comprises an antenna that has a length of at least approximately one-fourth the wavelength of the predetermined radio frequency to be received.

34. A communication system comprising at least two antenna means as defined in claim 29, said communication system communicating with radio frequency signals.

35. A communication system comprising at least two antenna means as defined in claim 30, said communication system communicating with radio frequency signals.

36. A communication system comprising at least two antenna means as defined in claim 31, said communication system communicating with radio frequency signals.

37. The processor means defined in claim 28, wherein the processor means is selected from the group consisting of a computer, terminal, printer, scanner, modem, bridge, router, concentrator, HUB, server, input/output device, and mass storage device.

38. The processor means defined in claim 30, wherein the processor means is selected from the group consisting of a computer, terminal, printer, scanner, modem, bridge, router, concentrator, HUB, server, input/output device, and mass storage device.

39. The antenna means as defined in claim 30, further comprising an interface means coupled between the processor means and the signal transmission means, and between the processor means and the signal reception means.

40. A device as defined in claim 39, wherein the interface means further comprises a network interface means for manipulating digital data, and a protocol translation means for translating between digital data and radio frequency signals, wherein the network interface means is in communication with the processor means and the protocol translation means, and the protocol translation means is also in communication with the signal transmission means and the signal reception means.

41. A device as defined in claim 27, wherein the electrically conductive path along a length of the gas filled tube has a length of at least approximately one-fourth the wavelength of the predetermined radio frequency.

42. A device as defined in claim 27, wherein the gas filled tube includes a gas having rise and fall times associated with the generation of the electrically conductive path that total less than 100 nanoseconds.

43. A device as defined in claim 27, further comprising a trigger means coupled to the gas filled tube for initiating the electrically conductive path.

44. A device as defined in claim 27, wherein said means for generating the electrically conductive path comprises a power source coupled to the gas filled tube for establishing a required voltage level to enable selective initiation of the electrically conductive path, said power source including radio frequency decoupling circuitry.

45. A device as defined in claim 27, wherein the gas filled tube includes opposing electrodes positioned at opposite ends of the electrically conductive path, said power source being coupled to the opposing electrodes and further including radio frequency decoupling means positioned electrically between the gas filled tube and the power source to prevent undesired radio frequency signals of the power source from being coupled into the electrically conductive path.

46. A device as defined in claim 27, wherein the electrically conductive path along a length of the gas filled tube is sufficiently short to enable triggering of the electrically conductive path based on voltage levels supplied by the discrete radio frequency signal to be transmitted, without need for separate triggering means.

47. A device as defined in claim 43, wherein the trigger means includes, a timing circuit associated with the radio frequency signal transmission means for coordinating synchronized initiation of the electrically conductive path immediately prior to arrival of the radio frequency signal to be transmitted, and further comprising cut-off means coupled to the means for generating the electrically conductive path for terminating said conductivity of the path in the gas filled tube immediately subsequent to transmission of the radio frequency signal to instantly terminate antenna transmission and thereby minimize a trailing resonant antenna transmission.

48. A device as defined in claim 27, wherein the gas filled tube includes a gas selected from the group consisting of neon, xenon, argon, krypton and combinations thereof.

* * * * *